US006085726A

United States Patent [19]

Lei et al.

[11] Patent Number: 6,085,726

[45] Date of Patent: Jul. 11, 2000

[54] FUEL INJECTOR

[75] Inventors: Ning Lei, Addison; Xilin Yang, Elk Grove Village, both of Ill.

[73] Assignee: Navistar International Transportation Corp., Chicago, Ill.

[21] Appl. No.: 09/212,060

[22] Filed: Dec. 15, 1998

Related U.S. Application Data

[60] Provisional application No. 60/086,128, May 20, 1998.

[51] Int. Cl.[7] ..... F02M 37/04

[52] U.S. Cl. ..... 123/446; 123/467; 123/496

[58] Field of Search ..... 123/446, 447, 123/467, 496, 299, 300; 239/88, 96

[56] References Cited

U.S. PATENT DOCUMENTS

| | | | |
|---|---|---|---|
| 5,181,494 | 1/1993 | Ausman et al. . | |
| 5,460,329 | 10/1995 | Sturman . | |
| 5,526,792 | 6/1996 | Guth et al. | 123/467 |
| 5,664,545 | 9/1997 | Kato et al. | 123/467 |
| 5,682,858 | 11/1997 | Chen et al. . | |
| 5,687,693 | 11/1997 | Chen et al. | 123/467 |
| 5,711,277 | 1/1998 | Fuseya | 123/496 |
| 5,819,704 | 10/1998 | Tarr et al. | 123/467 |
| 5,852,997 | 12/1998 | Vanderpoel | 123/300 |
| 5,878,720 | 3/1999 | Anderson et al. . | |
| 5,913,300 | 12/1998 | Drummond | 123/467 |

OTHER PUBLICATIONS

"HEUI Fuel System Operation", Brochure CGE 472–1, Navistar International Transportation Corp., Feb. 1995.

"Common Rail Injection System for Commercial Diesel Vehicles", W.Boehner et al, SAE Paper No. 970345, Society of Automotive Engineers, Inc., 1997.

"Injection Rate Shaping Technology with Common Rail Fuel System (ECD–U2)", K. Funai et al., SAE Paper No. 960107, Society of Automotive Engineers, Inc., 1996.

"A Common Rail Injection System for High Speed Direct Injection Diesel Engines", N.Guerrassi et al., SAE Paper No. 980803, Society of Automotive Engineers, Inc., 1998.

"Solenoid–Valve Controlled Diesel Distributor Injection Pump", W. Fisher et al., SAE Paper No. 930327, Society of Automotive Engineers, Inc., 1993.

"Development of J–Serie Engine & Adoption of Common–Rail Fuel Injection System", S.Endo et al., SAE Paper No. 970818, Society of Automotive Engineers, Inc., 1997.

"Benefits of New Fuel Injection System Technology on Cold Startability of Diesel Engines—Improvement of Cold Startability & White Smoke Reduction by Means of Multi Injection with Common Rail Fuel System (ECD–U2)", I. Osuka et al., SAE Paper No. 940586, Society of Automotive Engineers, Inc., 1994.

*Primary Examiner*—Thomas N. Moulis

*Attorney, Agent, or Firm*—Dennis Kelly Sullivan; Jeffrey P. Calfa

[57] ABSTRACT

A fuel injection event controller for a fuel injection nozzle includes a hydraulic lock device for selectively restricting the translatory opening of a fuel injection nozzle needle valve, the needle valve delivering a quantity of a fuel to a combustion chamber of an internal combustion engine. Methods of effecting rate shaping of the injection charge and of providing a two stage injection event are included.

38 Claims, 3 Drawing Sheets

FUEL INJECTOR

RELATED APPLICATIONS

This application claims the benefit of U.S. Provisional Application No. 60/086,128, filed May 20, 1998, which application is incorporated herein in its entirety.

TECHNICAL FIELD

This invention is related to internal combustion engines and, more particularly, to a fuel injector having fuel injection event control.

BACKGROUND OF THE INVENTION

Hydraulically-actuated unit fuel injectors are well known in the art and three types having different control valves are described in U.S. Pat. Nos. 5,181,494, 5,460,329, and 5,682,858. Each of these injectors incorporates an electronically-controlled control valve which operates on a hydraulic actuating fluid, such as engine lubricating oil, to operate a hydraulic intensifier piston. Fuel is introduced at a relatively low pressure to the high pressure side of the intensifier piston and, upon pressurization by the intensifier piston to a relatively very high pressure, is delivered to an injection nozzle portion of the injector. The very high pressure fuel lifts a needle valve or check valve from its seat against the closing force of a valve spring to open an injection orifice, thereby causing injection of a charge of fuel into an engine cylinder.

In general, the hydraulic actuating pressure can be varied while the quantity of fuel injected is controlled by the duration during which the actuating pressure is maintained on the intensifier piston. In U.S. Pat. No. 5,682,858, the force of the hydraulic actuating fluid also acts at times against the upper side of the needle check valve to control its opening and closing and thereby provide direct control of the needle check valve.

An important consideration for optimizing diesel exhaust emissions and reducing engine combustion noise is the ability to control the shape of the fuel injection curves, and/or fuel pressure vs. injection duration. This is known in the art as rate shaping. U.S. Pat. Nos. 5,181,494, 5,460,329, and 5,682,858 discuss a number of approaches to rate shaping.

Through rate shaping, the fuel injection curve can be tailored to provide small quantities of fuel during the initial portion of the injection event, control of a single fuel injection event, i.e., single shot injection, or may even cause a split shot injection event having a small pilot injection immediately followed by the large main quantity injection. It is believed that under certain conditions, producing split injection can be very beneficial to reduce overall engine emissions and to reduce diesel engine noise level. However, this small quantity of pilot injection has proved to be very difficult to achieve without introducing significant variability from one injection event cycle to the next event cycle. Pilot injection quantity variability from one injector to the next exists due to machining tolerances and partial motion of the needle check and control valve in the fuel injector. This variability is magnified when the injector is under high actuating pressure. High engine speed operation also magnifies the variability of the pilot injection.

A major cause of the difficulty with pilot injection is that the injector must be configured to provide an orifice of sufficient size for the large fuel quantities supplied for full load engine operation whereas pilot injection might utilize as little as one percent of the full load quantity. When this full size injector is used to inject a very small quantity, the relative variation of the orifice size between the opening for the pilot quantity and the opening needed for full load operation is great and controllability is therefore relatively poor. Since a fully open needle valve can flow too much fuel for small delivery under high injection pressure, it would be desirable to repeatably control the needle lift to effect a very small orifice size and thus greatly limit the fuel quantity delivered during pilot injection.

Under high speed and high load engine conditions, i.e., large quantities of fuel, a single shot, rate-shaped injection may be quite favorable compared to split injection while a split shot or pilot injection may be preferred at lower end of engine operation when low quantities of fuel are required.

SUMMARY OF THE INVENTION

This invention provides an injection nozzle having a two stage needle opening profile to control the total amount of effective nozzle orifice discharge flow area. The first stage of needle lift is very small to provide a stable and controllable pilot injection for split shot injection or to provide a rate shaped injection profile for single shot injection.

Further, this invention permits a rate-shaped injection at a single injection mode while still achieving stable and controllable pilot injection when split injection is desired.

Additional features of the present invention include:

(a) A small fuel delivery quantity at high operating pressure can be achieved through a cracked-open orifice resulting from the controlled needle valve motion provided by this invention. This cracked-open orifice can be controlled consistently through the limited needle opening provided by the event controller. The resulting small fuel delivery quantity is both stable and controllable.

(b) Two stage variable needle valve opening pressure or two stage needle lift is provided. The needle valve first opens at a fixed pressure level which is a function of the needle dimensions and the valve spring design. The second stage opening pressure varies with engine operating conditions, because the actuation pressure level is varied by the engine control microprocessor depending on the operating conditions. The configuration of the event controller of the present invention defines the relationship between the injection rate shape and the engine operating conditions. If the area ratio between the event controller lock valve ends is low and the actuation pressure is low, the event controller will open earlier than the needle valve opens and the hydraulic lock phenomena would not occur.

(c) By positioning the lock valve of the event controller of the present invention between the injection pressure passage and a rail pressure passage, the timing of the event controller opening depends on the injection pressure to actuation pressure ratio. The valve opening pressure (VOP) of the needle valve is not a fixed value, but is optimized according to engine conditions. This is the case because the needle valve second stage VOP may be adjusted to a desired pressure ratio level. Full lift of the needle valve, and thus full quantity fuel injection charge, is only obtained when injection pressure exceeds operation pressure by a desired ratio. If injection pressure is below the target, needle lift is greatly limited.

(d) An injector incorporating the present invention can deliver small injection quantities at very high fuel operation pressure. It is very common among other fuel injection systems that a small pilot injection gets more difficult to obtain as the injection pressure goes higher. The present invention provides small, controllable pilot injection without penalizing performance under other engine conditions.

(e) The present invention provides a two stage needle valve lift feature and thereby creates a slow initial injection rate naturally. This is an important feature for high speed engine operation since a rate-shaped single shot injection can be more efficient than a split injection under such operating conditions. The area ratio of the event controller is easily calibrated to suit specific engine performance criteria.

(f) With the event controller of the present invention, only the initial portion of the injection cycle is affected, or, as desired no effect on the injection cycle is produced, depending on the event controller configuration. The event controller only limits and slows down the initial needle valve lift and does not control the needle valve during the main injection event.

(g) Both the fluid flow and the lock valve motion of the event controller are relatively small. A small opening of the lock valve of the event controller is enough to release the hydraulic lock of the needle valve that limits the needle valve orifice opening.

(h) The event controller of the present invention allows a two stage needle valve lift. However, unlike a conventional two spring needle valve, this invention provides the equivalent of a variable second hydraulic spring. Unlike the prior art the spring effectively disappears during the main injection event so that there is no second stage hydraulic spring to affect needle valve motion during the main injection event, i.e. it only affects the initial injection rate.

The present invention is a fuel injection event controller for a fuel injection nozzle. The fuel injection event controller includes a hydraulic lock device for selectively restricting the translatory opening of a fuel injection nozzle needle valve, the needle valve for delivering a quantity of a fuel to a combustion chamber of an internal combustion engine. The present invention further includes methods of effecting rate shaping of the injection charge and of providing a two stage injection event are included.

DETAILED DESCRIPTION OF THE DRAWINGS

Figure 1:
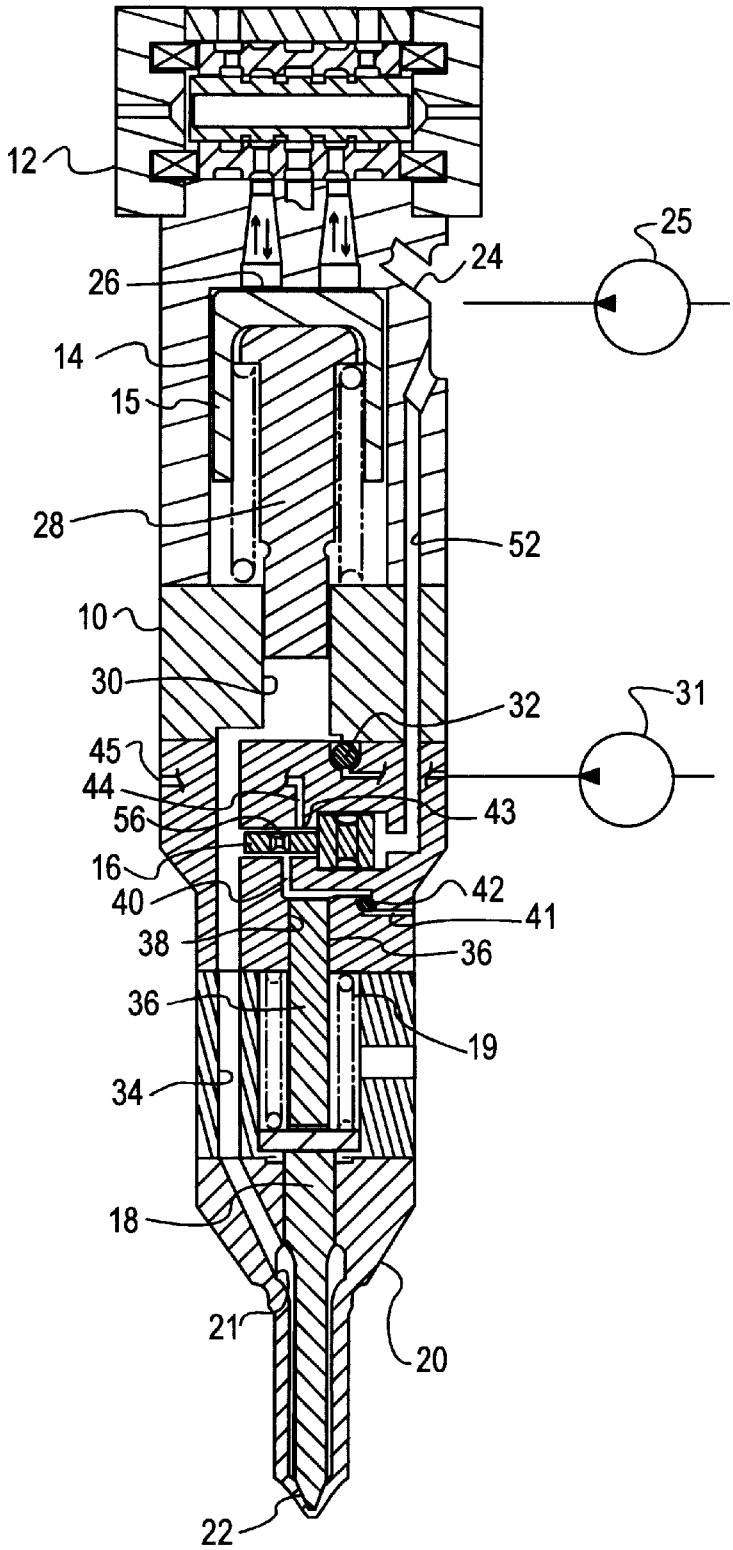
FIG. 1 is a sectional view of a fuel injector including the event controller of the present invention.

FIG. 1 shows a hydraulically-actuated, electronically-controlled injector unit 8 of the type described in U.S. Pat. No. 5,460,329, which is incorporated herein by reference, and which has been improved and incorporates the fuel injection event controller of the present invention. The injector body 10 of the injector unit 8 includes an injection control valve 12, a pressure intensifier 14, and a spring loaded differential-pressure-controlled needle valve 18 disposed in the injection nozzle portion 20, which has one or more injection orifices 22 disposed in its tip.

Relatively high pressure actuation liquid, preferably engine lubricating oil, is supplied to a control valve inlet 24 from an engine driven external pump 25, depicted schematically in FIG. 1, which may be independently controlled and pressurized to a desired pressure level under any given engine condition. Other liquids that are captured in a closed loop associated with the internal combustion engine could be used, such as transmission oil or brake fluid. The level of pressurization of the lubricating oil as supplied to injector unit 8 is preferably substantially greater than the pressure at which the lubricating oil is circulated through the engine for lubrication purposes. The high pressure lubricating oil is supplied through a high pressure rail 27, depicted schematically in FIG. 1.

The injection control valve 12 may be electronically actuated. The injection control valve 12 selectively controls the filling of the intensification chamber 26 with actuation liquid and the draining of the actuation liquid from the chamber 26 for each injection event. The chamber 26 is in fluid communication with the top 29 of the pressure intensifier piston 15 of the intensifier 14. The lower end of the intensifier 14 includes a plunger 28 having a compression area 33 that is substantially less than the area of the top 29 of the intensifier piston 15, the area ration of the top 29 to the area 33 being an intensification factor. The compression area 33 of the intensifier 14 is in fluid communication with the fuel to be injected into a combustion chamber.

Ignoring the event controller 16 of the present invention for the moment, the high pressure actuation liquid acting on the top 29 of the piston 15 increases the pressure of fuel acted on by the plunger 28 by a selected intensification factor, as indicated above. The compression area 33 of the plunger 28 is exposed to a selected volume of fuel which is introduced into a fuel chamber 30. The fuel is supplied to the fuel chamber 30 from an engine driven external pump 31, depicted schematically in FIG. 1, via a check valve 32. Thus, when the control valve 12 enables the pressure actuating fluid to be supplied to the intensification chamber 26, the pressure actuating fluid acts on the top 29 of pressure intensifier piston 15. The force generated on the top 29 of pressure intensifier piston 15 drives the plunger 28 downward. The fuel injection pressure is amplified by the compressive action of the compression area 33 of the intensifier 14 acting on the fuel in the chamber 30. The high pressure (intensified) fuel is supplied through passage 34 to the nozzle orifices 22 of the injection nozzle portion 20.

The high pressure fuel acts upwardly on the needle valve 18 to open the orifices 22, thereby controlling the discharge of high injection pressure fuel to the combustion chamber (not shown) of an internal combustion engine. In previous injectors without the event controller 16 of the present invention, as the fuel pressure built, the fuel pressure acting upward on the surface 35 of the needle valve 18 would lift the needle valve 18 against the bias of the valve spring 19, thereby unseating the needle valve 18 to allow fuel to be discharged from the nozzle injection orifices 22.

Figure 2:
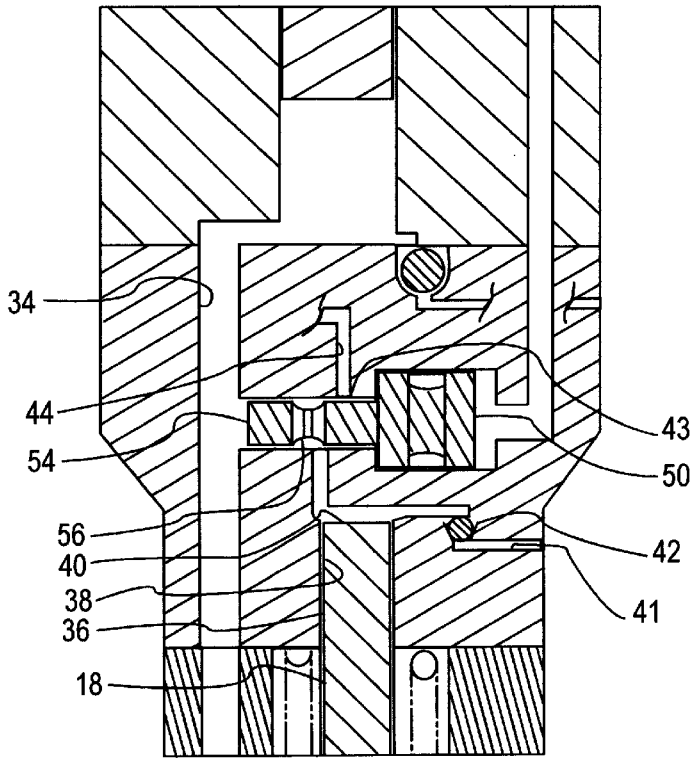
FIG. 2 is an enlarged sectional view of the event controller in the locked position.
Figure 3:
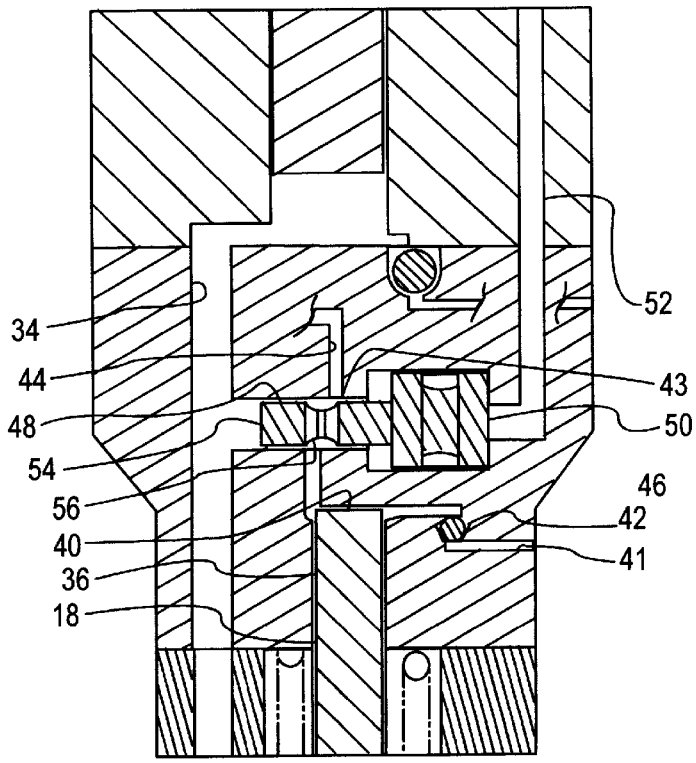
FIG. 3 is an enlarged sectional view of the event controller in the unlocked position.

The present invention incorporates the fuel injection event controller 16 into the previously described injector 8, as depicted in FIGS. 1–3. As will be described, the fuel injection event controller 16 provides for rate shaping control of the fuel injection event, rate control, and needle valve motion control. The event controller 16 generally includes a seal pin 36, a locking chamber 40, and a lock valve 39. The needle valve 18 extends upwardly to the seal pin 36. The seal pin 36 is slidingly received in a close sealing fit within a bore 38 of the valve body 10. The bore 38 opens into the locking chamber 40 defined at the upper margin of the seal pin 36. The locking chamber 40 is supplied with fuel through passage 41 from the external fuel supply pump 31 through a check valve 42. A needle back drain back passage 44 extends from the locking chamber 40 to a drain port 45. Fuel flowing through the drain port 45 returns to a fuel reservoir (not shown). Such fuel is always at the supply pressure of the engine fuel pump, approximately 50–60 psi.

The hydraulic lock valve 39 is disposed to intersect and seal the drain passage 44 and is hydraulically actuated to shift between a locked and unlocked disposition, thereby opening and closing a port 43 to the drain passage 44. When lock valve 39 is in the open (unlocked) configuration, port 43 opens the drain passage 44 from the locking chamber 40 to the drain port 45.

As best seen FIGS. 2 and 3, the hydraulic lock valve 39 of the present invention is piston-shaped and has a large piston 46 at a first end and a small piston 48 at an opposite second end to provide a differential in the surface areas between the two ends of the lock valve 39. The larger end piston surface 50 is exposed continuously to pressure from the high pressure hydraulic actuation fluid pump 25 through the high pressure rail 27 and the actuation fluid passage 52. The force generated by the actuation fluid pressure on the surface 50 is constant at a given engine operation condition and does not change during an injection event, since the pressure at the high pressure rail 27 is preferably regulated and controlled through an independent controller using a number of different sensed parameters that affect the engine. The pressure at the high pressure rail 27 varies, but is constant at any given engine operating condition.

The smaller end surface 54 of the lock valve 39 is exposed to the intensified high fuel injection pressure in the injection passage 34 that also conveys fuel to the nozzle 20. The force generated by the intensified high fuel injection pressure on the surface 54 changes as injection pressure increases and decreases during an injection event responsive to the compressive force exerted by the intensifier 14. However, since the intensification ratio of the pressure intensifier 14, preferably about 7:1, is greater than the ratio of the areas of the two end surfaces 50, 54, preferably about 4:1, the pressure differential across the lock valve 39 during the injection cycle causes the lock valve 39 to move from a closed (locked) position as depicted in FIGS. 1 and 2 to an open (unlocked) position as depicted in FIG. 3 when the force on end surface 54 exceeds the force on end surface 50.

There is a small dead volume of fuel trapped in the locking chamber 40 when the lock valve 39 is in the closed position, as depicted in FIGS. 1 and 2. The volume of the locking chamber 40 is sealed by the pin 36 at the upper end of the needle valve 18, by the check valve 42, and by the lock valve 39 when the lock valve 39 is in the closed position closing the needle back drain passage 44.

With the lock valve 39 in the closed position, trapped fuel in the chamber 40 will be compressed when the fuel injection pressure is increased by the intensifier 14 to open the needle valve 18. Since diesel fuel is generally considered to be incompressible, the needle valve would appear to be in a hydraulic lock condition preventing the needle valve 18 from being lifted from its seat to open orifices 22. However, under the very high fuel injection pressure conditions acting on the needle valve 18, as much as 21,000 psi, there is some compressibility of the diesel fuel trapped in chamber 40 and some leakage of fuel from the chamber 40, thereby enabling a very limited amount of needle lift to slightly open the needle valve orifices 22 without opening the lock valve 39. While it is not practical to eliminate all leakage, it is possible to design in the desired amount of leakage to give the desired amount of needle lift. A small channel can be defined to permit a desired amount of fuel leakage from chamber 40 to the needle back drain passage 44.

In a split shot injection, this limited opening of the orifices 22 enables a small pilot injection of fuel on the order of one percent of the maximum quantity of a main fuel injection that occurs when the orifices 22 are fully open. In a single shot injection, this enables a small quantity of fuel to be injected during the initial injection phase (approximately 200–500 psecs) before the main injection event takes place to shape the rate of injection.

When the fuel injection pressure in the passage 34 reaches a level sufficiently high so that the force on the surface 54 overcomes the force acting on the surface 50 from the actuation fluid passage 52, the lock valve 39 moves to the open (unlocked) position, as depicted in FIG. 3, so that spool groove 56 cut in the small end of the lock valve 39 intersects the port 43 and connects the trapped fuel in the locking chamber 40 to the drain passage 44. The fuel trapped in the locking chamber 40 then flows to the low pressure fuel supply 31. With the lock valve 39 open, the hydraulic lock on the needle valve 18 is removed and the needle valve 18 lifts up rapidly to its full travel position against the bias of spring 19, fully opening the orifices 22 to permit the large quantity main fuel injection from the orifices 22.

When the lock valve 39 moves toward its open (unlocked) position shown in FIG. 3, the drain port 43 does not immediately open because the drain port 43 is offset by a small distance from the spool grove 56 so that drain port 43 does not open until the travel of the lock valve 39 is greater than the offset distance. This offset distance delays the draining process from the locking chamber 40 and hence creates more rate shape effect. Additionally, since the valve 39 provides sealing between the lock chamber 40 and drain port 43, the length of the offset distance and fit tolerances of the valve 39 determine the amount of leakage which can occur around the small end spool 48 of the lock valve 39. As indicated above, some leakage may be desirable for rate shaping. The leakage gradually decreases the volume of fuel in lock chamber 40 to provide a gradual but small increase in the lift of the needle valve 18 after the initial opening of the orifices 22 and prior to the main injection from the orifices 22 of the needle valve 18. The gradual leakage causes a ramp up of the rate of fuel injection during the pilot injection phase of the injection event.

The difference in the force exerted by the fuel injection pressure on the surface 35 of the needle valve 18 and the opposing load of the spring 19 defines the first stage of valve opening pressure (VOP). This is the same as a conventional needle VOP setting. The fuel injection pressure level at which the lock valve 39 opens is called the second stage valve opening pressure. The second stage VOP varies with actuation pressure level for a given lock valve 39 configuration. Since the hydraulic actuation pressure level is controlled externally and varies with engine operation condition, the second stage VOP is a function of engine operating conditions. The lock valve 39 configuration may be adjusted empirically to provide the appropriate duration of the pilot injection or the amount of rate shaping suitable for a specific engine. Such adjustments may include: varying the area ratios of the areas 50, 54; adjusting the tolerances of the small end spool 48 to affect fuel leakage (more generous tolerances permitting more fuel leakage) defining a leak channel to affect the leakage at the small end spool 48; altering the distance that the drain port 43 is offset from the spool grove 56 (a greater distance providing for a greater span of time between when the lock valve commences to open and when the hydraulic lock is broken); to adjust the amount of leakage in the bore 38; adjusting the diameters of the seal pin 36 and the bore 38 to provide a different level of force on the seal pin 36 exerted by the pressure in the lock chamber 40; and varying the level of the first stage VOP by changing the load of the needle valve spring 19.

Description of Operation (1) Single Shot Injection With Rate Shaping Feature

Figure 4A:
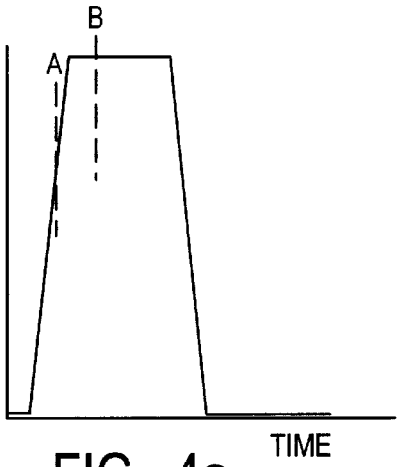
FIG. 4*a* is a graphic representation of the control valve signal with respect to time for a full injection event.
Figure 4C:
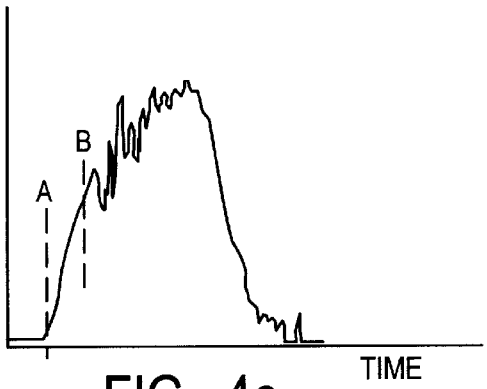
FIG. 4*c* is a graphic representation of the injection pressure with respect to time responsive to the control valve signal of FIG. 4*a*.
Figure 4B:
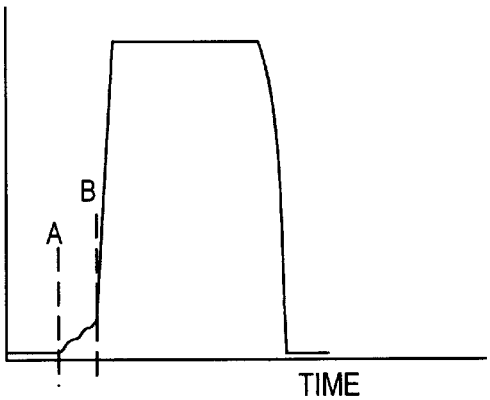
FIG. 4*b* is a graphic representation of the needle valve motion with respect to time responsive to the control valve signal of FIG. 4*a*.
Figure 4D:
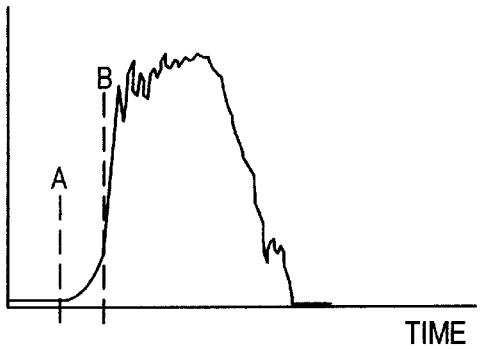
FIG. 4*d* is a graphic representation of the flow rate of injection with respect to time responsive to the control valve signal of FIG. 4*a*.

The operation as is described herein is graphically depicted in FIGS. 4*a*–4*b*. In an injection event and before turning on the injection control valve 12, the intensifier 14 is vented to ambient pressure and is at its uppermost position, as depicted in FIG. 1. The needle valve 18 is closed under the bias of the valve spring 19 and fuel in the nozzle chamber 21 is at its minimum fuel pressure level, i.e. supply pump pressure as provided by pump 31 to the fuel rail 57 and past the check valve 32. The lock valve 39 is in the closed (locked) position due to greater hydraulic force on surface 50 from the actuation fluid passage 52 than the force on surface 54. The drain passage 44 is closed and trapped fuel is sealed in the locking chamber 40 at minimum fuel pressure by the locking valve 39.

As the injection control valve 12 opens, high pressure actuation liquid flows into chamber 26 and bears on the intensifier 14. This pressure generates a force causing the intensifier piston 15 to move downward to magnify the fuel pressure by the intensification factor. See point A in FIGS. 4*a*–4*d*. The fuel injection pressure thus increases dramatically in the passageway 34 and at the nozzle chamber 21. The lock valve 39 remains in the closed position due to the relatively low injection pressure acting on surface 54 at this stage, as compared with the force acting on surface 50. Therefore, fuel trapped at back of the needle 18 in the locking chamber 40 is in a substantially hydraulically locked condition. As fuel pressure increases, the needle valve 18 cracks open orifices 22 slightly once the fuel injection pressure reaches first stage valve opening pressure level as defined by the load of the needle valve spring 19, but only to a very limited lift due to the relative incompressibility of the fuel captured in the chamber 40. The lift opens the orifices 22 a very small amount. Injection of fuel starts through the orifices 22 but at a very small injection rate due to the limited effective flow area of the orifices 22 at nozzle 20 resulting from the limited lift of the needle valve 18.

Fuel injection pressure continuously builds up and eventually the fuel injection pressure reaches the second stage valve opening pressure level, the pressure at which the lock valve 39 opens by shifting from the locked position to the unlocked position. See point B in FIGS. 4*a*–4*d*. At this moment, the hydraulic force on the lock valve 39 on the high pressure fuel passage side (surface 54) is greater than that on the actuation pressure side (surface 50). Accordingly, the lock valve 39 opens (unlocks) and releases the locking hydraulic pressure on the back of the needle valve 18. The needle valve 18 then lifts to the end of its travel without hydraulic resistance (thereby compressing spring 19) to provide the full fuel injection quantity to the combustion chamber commanded by the engine controller.

At the end of injection, the control valve 12 closes and actuation pressure on top of the intensifier 14 is drained to ambient, allowing the intensifier piston 15 and the plunger 28 to return to their uppermost positions. The injection pressure decays and the lock valve 39 is returned to the closed (locked) disposition by the force acting on surface 50. The needle valve 18 returns to its seated, closed position under the bias of spring 19. During lock valve 39 closing, the one-way check valve 42 at back of the needle valve 18 opens up to refill the locking chamber 40 while the check valve 32 opens up to refill the main fuel cavity 30. The injector unit 8 is then ready for the next injection event.

(2) Split Pilot Injection Operation

Split injection is achieved by opening and closing the digital injection control valve 12 twice, i.e., two independent pulse-width-controlled, single injection events happen in a very close time sequence for each ignition stroke of the engine. When a minimum pulse width signal is provided to the injector control valve 12 to produce a pilot injection, the needle valve 18 opens minimally at first stage VOP and pilot injection is produced. However, since the pilot pulse width is short, there is not enough time for the fuel pressure to increase enough to open the lock valve 39. Since the lock valve 39 does not open at all, the needle valve 18 lift is limited to first stage (pilot) injection only. Therefore, a small pilot injection can be achieved even at very high injection pressure condition. Since needle valve 18 lift is limited to a very small amount during pilot injection, needle valve 18 round trip time is much shorter than without the lock valve 39. Thus, the end of the pilot injection and the dwell period between the pilot injection and the main injection are very clear and sharp. When the pulse width signal for the main injection is given, the needle valve 18 opens again. However, the needle valve 18 will provide a rate shaped initial injection as described above for pilot injection, followed by a sharp rise to the rest of the main injection after the lock valve 39 is opened.

FIG. 4 illustrates the anticipated characteristics of this injection system. One can change the event controller configuration and the needle seal pin clearance to alter the characteristics. It is clear from the injection rate trace that a slow initial rate of injection is followed by a faster rise of main injection. Needle motion has a typical two stage profile.

Variations within the spirit and scope of the invention described are equally comprehended by the foregoing description.

What is claimed is:

1. A fuel injection event controller for a fuel injection nozzle, comprising:

hydraulic lock means for selectively restricting the translatory opening of a fuel injection nozzle needle valve, the needle valve delivering a quantity of a fuel to a combustion chamber of an internal combustion engine, said hydraulic lock means being responsive to the pressure of said quantity of fuel.

2. The fuel injection event controller of claim 1 wherein the selective restriction of the opening of the fuel injection nozzle needle valve effected by the hydraulic lock means is a function of a selected ratio between a rail pressure of an actuation liquid and a fuel injection pressure.

3. The fuel injection event controller of claim 1 wherein the hydraulic lock means is selectively shiftable between a locked configuration and an unlocked configuration, the translation of the needle valve being a function of the compressibility of the fuel when the hydraulic lock means are in the closed configuration.

4. The fuel injection event controller of claim 3 wherein the hydraulic lock means controls the opening of the fuel injection nozzle needle valve to delivery a relatively small pilot discharge of fuel when the hydraulic lock means are in the closed configuration, when hydraulic lock means are in effective.

5. The fuel injection event controller of claim 3 wherein the hydraulic lock means hydraulically locks the fuel injection nozzle needle valve when the hydraulic lock means are in the closed configuration.

6. The fuel injection event controller of claim 1 wherein the hydraulic lock means selectively controls the translatory opening of the fuel injection nozzle needle valve for delivering a single shot injection fuel charge with rate shaping from the fuel injection nozzle needle valve to the combustion chamber of the internal combustion engine.

7. The fuel injection event controller of claim 1 wherein the hydraulic lock means are controlled to selectively control the translatory opening of the fuel injection nozzle needle valve for delivering a split pilot fuel charge and main fuel charge from the fuel injection nozzle needle valve to the combustion chamber of the internal combustion engine.

8. The fuel injection event controller of claim 2 wherein the hydraulic lock means capture a selected volume of fuel in a chamber defined in part by a portion of the needle valve.

9. The fuel injection event controller of claim 8 wherein the fuel injection pressure acts on the needle valve thereby effecting translation of the needle valve, the translation of the needle valve acting to compress the selected volume of fuel in the chamber and to open a needle valve orifice to deliver a selected fuel charge from the fuel injection nozzle needle valve to the combustion chamber of the internal combustion engine.

10. The fuel injection event controller of claim 1 wherein the hydraulic lock means include a piston, the piston being affected by a first and a second pressure, the first pressure being actuation liquid rail pressure and the second pressure being a fuel injection pressure.

11. The fuel injection event controller of claim 10 wherein the piston includes a first pressure bearing surface and an opposedly acting second pressure bearing surface, the first pressure bearing surface being exposed to the rail pressure of actuation liquid and the second pressure bearing surface being exposed to the fuel injection pressure.

12. The fuel injection event controller of claim 10 wherein the piston is shiftable between a locked configuration and an unlocked configuration, the piston being shifted in the locked configuration when a force exerted by the rail pressure of actuation liquid on the first pressure bearing surface is greater than the force exerted by the fuel injection pressure on the second pressure bearing surface.

13. The fuel injection event controller of claim 10 wherein a piston first pressure bearing surface area and a piston second pressure bearing surface area are selected to effect a certain pressure ratio between the rail pressure of actuation liquid and the fuel injection pressure at which the piston is shifted between a closed configuration and an open configuration.

14. A fuel injector for selectively delivering a selected charge of fuel to a combustion chamber of an internal combustion engine, comprising:

a fuel injection event controller having hydraulic lock means for selectively restricting the translatory opening of a fuel injection nozzle needle valve, the needle valve delivering a quantity of a fuel to a combustion chamber of an internal combustion engine, said hydraulic lock means being responsive to the pressure of said quantity of fuel.

15. The fuel injector of claim 14 wherein the selective restriction of the opening of the fuel injection nozzle needle valve effected by the hydraulic lock means is a function of a selected ratio between a rail pressure of actuation liquid and a fuel injection pressure.

16. The fuel injector of claim 14 wherein the hydraulic lock means is selectively shiftable between a locked configuration and an unlocked configuration, the translation of the needle valve being a function of the compressibility of the fuel when the hydraulic lock means are in the closed configuration.

17. The fuel injector of claim 16 wherein the hydraulic lock means controls the opening of the fuel injection nozzle needle valve to delivery a relatively small pilot charge of fuel when the hydraulic lock means are in the locked configuration.

18. The fuel injector of claim 16 wherein the hydraulic lock means hydraulically locks the fuel injection nozzle needle valve when the hydraulic lock means are in the locked configuration.

19. The fuel injector of claim 14 wherein the hydraulic lock means selectively controls the translatory opening of the fuel injection nozzle needle valve for delivering a single shot injection fuel charge with rate shaping from the fuel injection nozzle needle valve to the combustion chamber of the internal combustion engine.

20. The fuel injector of claim 14 wherein the hydraulic lock means are controlled to selectively control the translatory opening of the fuel injection nozzle needle valve for delivering a split pilot fuel charge and main fuel charge from the fuel injection nozzle needle valve to the combustion chamber of the internal combustion engine.

21. The fuel injector of claim 15 wherein the hydraulic lock means capture a selected volume of fuel in a chamber defined in part by a seal pin surface, the surface being in translatory communication with the needle valve for affecting translation of the needle valve.

22. The injector of claim 21 wherein the fuel injection pressure acts on the needle valve thereby effecting translation of the needle valve, the translation of the needle valve acting to compress the selected volume of fuel in the chamber and to open a needle valve orifice to deliver a selected fuel charge from the fuel injection nozzle needle valve to the combustion chamber of the internal combustion engine.

23. The fuel injector of claim 14 wherein the hydraulic lock means include a piston, the piston being affected by a first and a second pressure, the first pressure being rail pressure of an actuation liquid and the second pressure being a fuel injection pressure.

24. The fuel injector of claim 23 wherein the piston includes a first pressure bearing surface and an opposedly acting second pressure bearing surface, the first pressure bearing surface being exposed to the rail pressure of the actuation liquid and the second pressure bearing surface being exposed to the fuel injection pressure.

25. The fuel injector of claim 23 wherein the piston is shiftable between a locked configuration and an unlocked configuration, the piston being shifted in the locked closed configuration when a force exerted by the fuel rail pressure on the first pressure bearing surface is greater than the force exerted by the fuel injection pressure on the second pressure bearing surface.

26. The fuel injector of claim 23 wherein a piston first pressure bearing surface area and a piston second pressure bearing surface area are selected to effect a certain pressure ratio between the rail pressure of actuation liquid and the fuel injection pressure at which the piston is shifted between a locked configuration and an unlocked configuration.

27. A method of controlling the translation of a needle valve of a fuel injector, comprising the steps of:

providing a charge of fuel to at least one surface of the seated, closed needle valve under pressure;

intensifying the pressure of the charge of fuel, the intensified fuel pressure acting on the at least one needle valve surface to shift the needle valve off a valve seat;

at least partially hydraulically locking the needle valve to resist the shifting action of the needle valve.

28. The method of claim 27 further including the step of minimizing a translation of the needle valve for providing a controlled pilot opening of the needle valve and delivery of a pilot charge of fuel.

29. The method of claim 27 including the step of selectively releasing the hydraulic lock to permit a full translation of the needle valve to a fully open position to deliver a main charge of fuel.

30. The method of claim 27 including the step of selectively leaking a portion of a hydraulic fluid comprising the hydraulic lock to permit a gradually increasing opening of the needle valve to provide rate shaping of a fuel charge.

31. The method of claim 27 including the step of controlling the intensification of the pressure of actuation liquid to effect the delivery of the pilot charge of fuel spaced apart in time from the delivery of a main charge of fuel.

32. A fuel injector having a variable second stage valve opening pressure for providing a first stage needle valve lift and a second stage needle valve lift, the valve lift effecting the opening of at least one orifice for the injection of a charge of fuel through the at least one orifice to a combustion chamber of an internal combustion engine.

33. The fuel injector of claim 32 further including a hydraulically actuated fuel injection event controller, the fuel injection event controller being adjustable empirically to provide the appropriate duration of a pilot injection and of an amount of rate shaping suitable for a specific engine.

34. The fuel injector of claim 33 wherein the hydraulically actuated fuel injection event controller includes a piston having a first and a second opposed surfaces, the first surface for being exposured to a first working fluid and the second surface for being exposed to a second working fluid, varying the area ratios of the first and a second opposed surfaces effecting an adjustment of the fuel injection event controller to provide the appropriate duration of the pilot injection and of the amount of rate shaping.

35. The fuel injector of claim 33 wherein tolerances between a portion of the piston and a surrounding cylinder are adjusted to define a fluid leak channel, fluid leakage through the leak channel effecting an adjustment of the fuel injection event controller to provide the appropriate duration of the pilot injection and of the amount of rate shaping.

36. The fuel injector of claim 33 wherein the hydraulically actuated fuel injection event controller piston is translatably positioned in a cylinder, a fluid drain port intersecting the cylinder and the piston having a spool portion being selectively in fluid communication with a fluid chamber, fluid in the fluid chamber being drainable from the chamber when the spool portion is in registry with the drain port, the spool portion being offset from the drain port a select distance when the piston is in a closed configuration, altering the distance that the drain port is offset from the spool portion effecting an adjustment of the fuel injection event controller to provide the appropriate duration of the pilot injection and of the amount of rate shaping.

37. The fuel injector of claim 33 wherein the hydraulically actuated fuel injection event controller piston is translatably positioned in a cylinder, a fluid drain port intersecting the cylinder and the piston having a spool portion being selectively in fluid communication with a fluid chamber, fluid in the fluid chamber being drainable from the chamber when the spool portion is in registry with the drain port, a seal pin being operably coupled to a fuel injector needle valve, the seal pin being translatable in a pin bore and defining a portion of the fluid chamber,adjusting the tolerances between the seal pin and the pin bore to provide fluid leakage from the fluid leakage in the bore effecting an adjustment of the fuel injection event controller to provide the appropriate duration of the pilot injection and of the amount of rate shaping.

38. The fuel injector of claim 33 wherein the first stage needle valve lift commences at a selected valve opening pressure, varying the pressure of the first stage valve opening pressure by changing the load of a needle valve spring of a fuel injector needle valve effects an adjustment of the fuel injection event controller to provide the appropriate duration of the pilot injection and of the amount of rate shaping.

* * * * *